United States Patent [19]

Taylor et al.

[11] Patent Number: 4,862,714

[45] Date of Patent: Sep. 5, 1989

[54] PUSH-BUTTON PADLOCKS HAVING SWIVEL-ONLY SHACKLES

[75] Inventors: Jewell A. Taylor, Salinas, Calif.; Robert J. Bretl, Menominee, Mich.

[73] Assignee: Lock-R-Lock, Inc., Salinas, Calif.

[21] Appl. No.: 220,586

[22] Filed: Jul. 18, 1988

[51] Int. Cl.[4] ..... E05B 37/18

[52] U.S. Cl. ..... 70/25; 70/298

[58] Field of Search ..... 70/22, 24, 25, 26, 27, 70/28, 29, 32, 33, 34, 21, 297, 298, 287, 288

[56] References Cited

U.S. PATENT DOCUMENTS

| | | | |
|---|---|---|---|
| 206,528 | 7/1878 | Bramble | 70/33 |
| 880,932 | 3/1908 | Swoggers | 70/33 |
| 1,222,082 | 4/1917 | Descalles | 70/29 |
| 1,618,841 | 2/1927 | McMenamin | 70/26 |
| 1,835,317 | 12/1931 | Miller | 70/33 |
| 4,176,533 | 12/1979 | Nordendale | 70/298 |
| 4,660,394 | 4/1987 | Wu | 70/25 |
| 4,671,084 | 6/1987 | Lin | 70/25 |
| 4,751,830 | 6/1988 | Cheng | 70/25 |

FOREIGN PATENT DOCUMENTS

| | | | |
|---|---|---|---|
| 353471 | 5/1922 | Fed. Rep. of Germany | 70/33 |

*Primary Examiner*—Robert L. Wolfe

*Attorney, Agent, or Firm*—Polster, Polster and Lucchesi

[57] ABSTRACT

A push-button padlock having a swivel-only shackle, the free end of which is receivingly engaged by a sleeve that is reciprocable into the padlock body housing upon actuation of a thumb latch member projecting through the housing, preferably through a hole in the front face. The shackle is an inverted J-shaped shackle with the longer end entrained in the padlock body where it engages a latching mechanism which includes the thumb latch and shackle sleeve members. The thumb latch is preferably of breakaway construction and the sleeve may be rotatable. A locking mechanism of any desired type to selectively lock and unlock the latching mechanism may be employed. The preferred locking mechanism is of push-button type, comprising a button block member having a plurality of holes in a spaced array for receiving and retaining two types of buttons, one or more Type A Combination Button(s) and the balance being Dead Pin B Buttons. A transverse bore in the button block intersects the push-button holes to receive a resilient member that engages arcuate grooves in the side of the push-buttons in a first up position and a second, depressed position. The buttons are configured adjacent their lower ends to engage slots in the locking plate, which slots are interspersed with enlarged arcuate relieved portions (holes) aligned with holes in the faces of the lock and the button block. The buttons are configured with adjacent blocking and passing diameter portions that either prevent or permit the locking plate to reciprocate when the correct combination buttons are pressed.

57 Claims, 3 Drawing Sheets

PUSH-BUTTON PADLOCKS HAVING SWIVEL-ONLY SHACKLES

FIELD

The invention relates to locks having shackles which only pivot, rather than reciprocate, to open. More particularly the invention relates to padlocks having a pivot-only shackle assembly in combination with any type of internal locking mechanism(s), preferably a push-button locking assembly. The pivot-only shackle type padlock of this invention has advantages of being less complex, inexpensive, fewer parts, ease of assembly, and exhibits up to a 4-8 fold increase in the amount of prying force required to force open the lock.

BACKGROUND

It has been known in the prior art of exposed shackle padlocks to provide shackle assemblies for which a reciprocating movement between the shackle and the lock housing is required to open the padlock. The most common form of these padlocks comprises a relatively complex arrangement of locking members to latch and release the shackle relative to the padlock body. These padlocks have an inverted J-shaped shackle that when released, moves upwardly out of the body to achieve relative reciprocal movement. The short end of the shackle will then pivot to open only after clearing the padlock body, and the long end is entrained in the locking mechanism. These type of padlocks are generally called reciprocating shackle padlocks.

Another variation on this theme of relative reciprocal movement between the shackle and the padlock body is a reversal of parts as shown in Atkinson, U.S. Pat No. 3,837,189 issued Sept. 24, 1974. The Atkinson design padlock comprises an inverted U-shaped shackle with one end fractionally shorter than the other, and a lock body having an outer shell and an inner core which are adapted to move a constrained amount relative to each other. When the locking mechanism is activated to an "open" position, the shorter end of the shackle is released by downward movement of the outer shell. This permits the shackle to pivot open.

One serious problem with reciprocating padlocks is that internal space limitations do not provide sufficiently deep recess for the free end of the shackle. Due to the inherent play in the lock mechanism in securing the entrained end of the shackle, the shackle often can be pulled out a sufficient distance to clear the upper end of the padlock body to be pivoted open. There is nothing to prevent the shackle from pivoting once it clears the upper surface of the padlock body. The force necessary to open some padlocks is as little as 140 lbs; many high school-age young men can pull open such locks easily by hand.

Another disadvantage of many current padlocks is the use of rotary dials. Rotary dials can not be used in the dark or by many handicapped people, and often dexterous, fully sighted persons have difficulty opening such locks even in daylight. In addition, rotary dial operation is slow and requires relative precision of alignment of the dial markings with the index, and the settings are imprecise in all but the most expensive locks.

There are also disadvantages with the use of key locks. Keys are an inconvenience to carry around and can be easily lost or stolen. Most people would prefer to keep a combination in their head rather than to add another key to their key ring.

Push-button locks, such as the Cheng patent, U.S. Pat. No. 4,751,830, issued June 21, 1988, have significant advantages over rotary dial and key locks. The positive action of a push-button lock allows for quick, easy and accurate operation. They offer the relative pick-resistance of rotary dial locks in that they are combination locks, and also can be opened in the dark, or by sightless or physically handicapped persons. One disadvantage with current push-button padlocks is the amount of internal parts required which results in a padlock that is that is complex to assemble. Another disadvantage is that the padlocks are susceptible to being opened by a small prying forces as a result of the inherent amount of play in a exposed shackle reciprocating padlock.

Accordingly, there is a need in the art for a strong padlock that is easy to operate, inexpensive to assemble and has a simplicity that does not yield excessive play permitting opening by a small prying force.

THE INVENTION

Objects

It is among the objects of this invention to provide an improved and simplified lock characterized by a pivoting only shackle that is stronger than conventional exposed shackle locks, and is very easy to manufacture and operate.

It is another object to provide a pivot-only shackle that is resistant to greater loads of prying force than conventional locks, since the excess play inherent in a reciprocating locking mechanism is eliminated.

It is another object to provide a reciprocable cylindrical sleeve which is operated by a thumb latch to releasably engage the free end of the shackle, and where the thumb latch is fabricated to break-away upon exertion of excessive force as a means to prevent tampering.

It is another object of this invention to provide an improved push-button locking assembly, which is simple to manufacture and assemble and provides for easy selection of a wide variety of combinations involving either single or multiple buttons.

It is another object of this invention to provide an improved push-button combination locking mechanism which may be used with the pivot-only shackle and latching assembly of this invention, or with any of the more conventional reciprocating shackle-type mechanisms.

It is another object of this invention to provide an improved push-button locking mechanism which may be used with auxiliary master key type locking mechanisms.

It is another object of this invention to provide an improved push-button locking mechanism comprising a simple button block having push-button holes therein for receiving two types of buttons, which buttons are positively retained in either an up or depressed position by simple resilient member which transversely intersects and engages the buttons.

It is another object of this invention to provide special push-buttons of two varieties, a Combination Type button and a Dead Pin Type button, which buttons are particularly adapted for use in push-button locking mechanisms.

Still other objects will be evident from the specification, drawings, abstract and claims.

Summary

The invention comprises in operative combination a push-button padlock having a housing, an inverted generally J-shaped shackle, a reciprocable shackle latching assembly including a thumb latch and a hardened sleeve, and a locking mechanism. The shackle is adapted to only pivot, called a swivel-only shackle, the free end of which is receivingly engaged by the sleeve which is reciprocable into the padlock body housing upon actuation of a thumb latch member projecting through the housing, preferably through a hole in the front face. The inverted J-shaped shackle has its longer end entrained in the padlock body where it engages a latching mechanism which includes the thumb latch and shackle sleeve members. The thumb latch is preferably of breakaway construction and the sleeve may be rotatable. A locking mechanism of any desired type to selectively lock and unlock the latching mechanism may be employed.

The preferred locking mechanism is of push-button type, and comprises a button block member having a plurality of holes in a spaced array for receiving and retaining two types of buttons, one or more Combination Pin buttons (Type A buttons) and the balance being Dead Pin buttons (Type B buttons). A transverse bore in the button block intersects the push-button holes and receives a resilient member that engages arcuate grooves in the side of the push-buttons to retain them in either a first up position or a depressed position. The buttons are configured adjacent their lower ends to engage slots in the locking plate, which slots are interspersed with enlarged arcuate relieved portions (holes) aligned with holes in the faces of the lock and the button block. The buttons are configured with adjacent blocking and passing diameter portions that either prevent or permit the locking plate to reciprocate when the correct combination buttons are pressed.

The combination is easily changed by preselected placement of the Combination Pin Type A buttons in the appropriate holes in the button block. The Dead Pin Type B button has a selected base diameter that when depressed into the slotted locking plate prevents the shackle latching assembly from moving. The Combination Type A button, when depressed, allows for sufficient clearance of the slotted locking plate so that the latching assembly may reciprocate, thus releasing the shackle. The user must push only Type A Combination buttons, and none of the Type B Dead Pin buttons in order that the thumb latch may be actuated to open the padlock. The combination of buttons are preferably nonsequence dependent. This reduces the complexity of the overall locking mechanism and reduces the need to memorize a particular combination number sequence.

A shackle retaining pin prevents vertical reciprocating movement and play in the shackle. A shackle pivot lock pin prevents the shackle from being rotated to the open position even if a thief were to saw off the sleeve.

BRIEF DESCRIPTION OF THE DRAWINGS

The principles of the invention are further illustrated in the drawings in which:

FIG. 4 is a section view taken along line 4—4 of FIG. 3 illustrating push-buttons actuated in the correct combination to permit opening of the lock;

FIG. 5 a section view through a line 5—5 in FIG. 3 showing the push-buttons depressed in the wrong combination, thus preventing the lock from being opened;

FIG. 6 is a section view taken along line 6—6 in FIG. 2 showing the two types of buttons, the combination button A and the Dead Pin B Button being both in an up, neutral position, which prevents the lock from being opened;

FIG. 7 is a transverse sectional view taken along line 7—7 of FIG. 2 showing the combination button A in the depressed position as part of the correct combination thereby permitting the lock to be opened;

FIG. 8 is a transverse sectional view taken along line 8—8 of FIG. 2 showing the dead pin being depressed while the combination pin is not depressed, this representing a wrong combination and thereby preventing the lock from being opened;

DETAILED DESCRIPTION OF THE BEST MODE OF THE INVENTION

The following detailed description illustrates the invention by way of example, not by way of limitation of the principles of the invention. This description will clearly enable one skilled in the art to make and use the invention, and describes several embodiments, adaptations, variations, alternatives and uses of the invention, including what we presently believe is the best mode of carrying out the invention.

Figure 1:
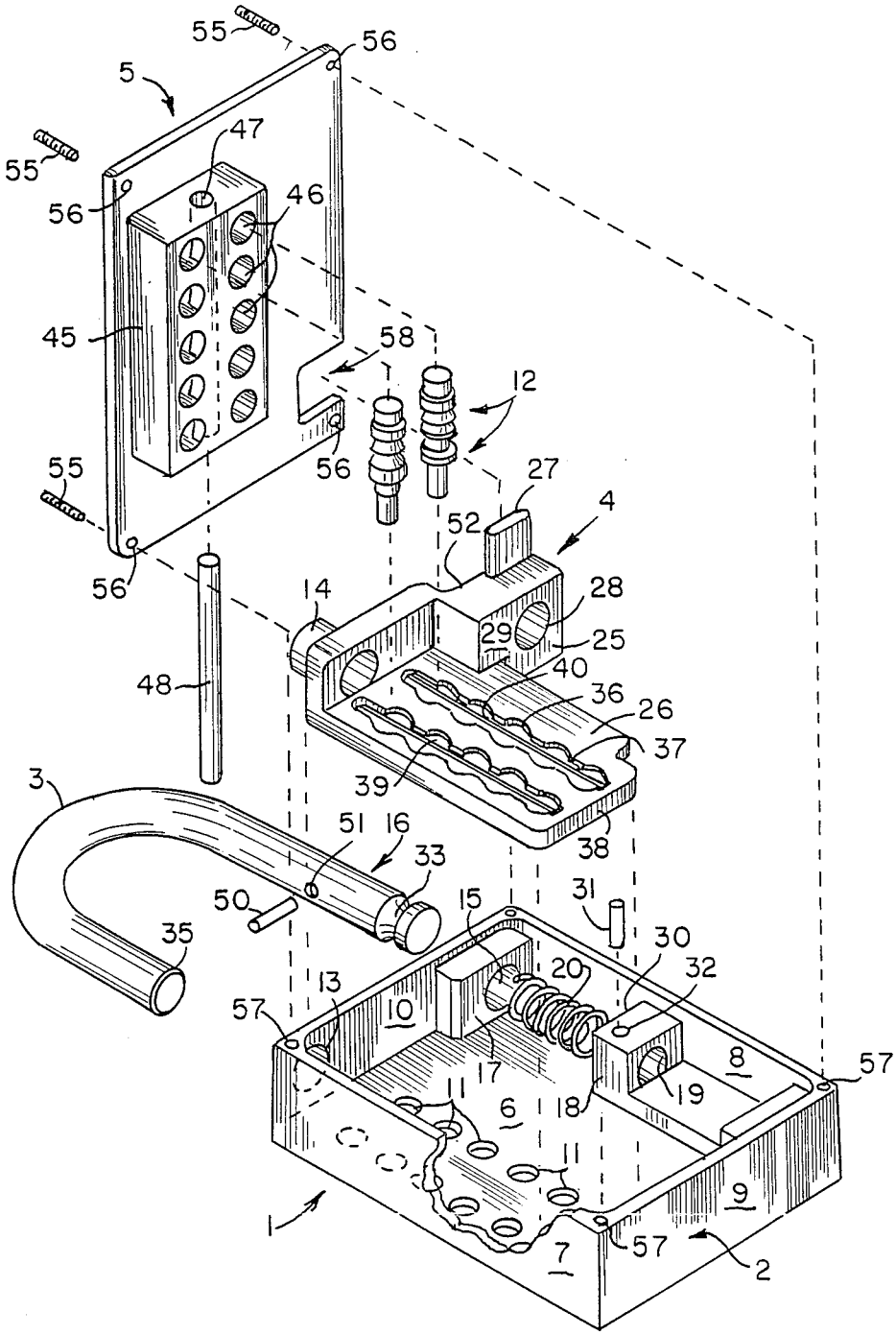
FIG. 1 is an exploded perspective view of the lock in accordance with this invention showing the inter-relationship of the parts.

FIG. 1 shows in exploded perspective view the push-button padlock 1 of this invention which comprises a lock housing 2, an inverted J-shaped shackle 3, a thumb latch assembly 4, and a face plate 5. The lock housing may be of any general shape, but is preferably generally rectangular and comprises a back plate 6, opposed, spaced apart side walls 7 and 8, a bottom wall 9, and a top wall 10. The walls are upstanding with respect to the backplate. They may be integral with the backplate or secured thereto with any convenient fastening means.

While the push-button padlock is illustrated in the drawings as having 10 push-buttons, it should be understood that any convenient number of push-buttons may be provided. Generally, the more buttons that are provided, the greater number of combinations are available. Accordingly, if a great number of combinations is desired, then the number of push-buttons should be increased. In addition, the push-buttons are shown arrayed in two parallel rows, but it should be understood that the push-buttons may be arrayed in one or more rows, or could be spaced in any type of pattern, such as a circular or triangular pattern or the like.

In the current best mode example shown, that of a 10-button push-button padlock having two rows of five buttons, the backplate 6 of the lock housing 2 has a series of holes 11 provided therein through which the end portion of the button pins 12 pass. The top wall 10 has provided therein a hole 13 through which the sleeve 14 of the thumb latch assembly 4 may reciprocate. Spaced laterally from hole 13 and aligned in the same plane is a hole 15 in the top wall 10 which receives the long, entrained 16 end of the J-shaped shackle 3. The lock housing is provided with an upper journal block 17, which includes a hole which is aligned and a continuation of hole 15 in the top wall 10. The lock housing 2 is also provided with a lower journal block 18 which has a hole 19 that is axially aligned with the hole 15 passing through the top wall 10 and upper journal block 17 of the lock housing. Compression spring 20 which receivingly engages the entrained end 16 of the J-shaped shackle will be described in more detail below.

Figure 2:
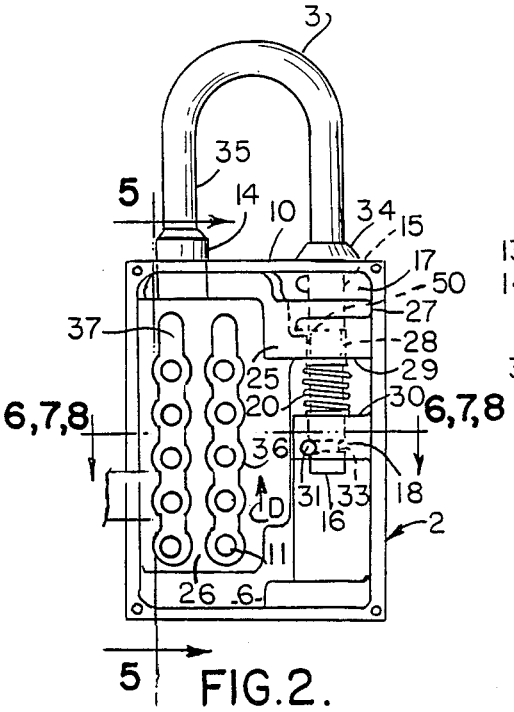
FIG. 2 is a front elevation with the face plate removed showing the internal mechanism of the lock in the locked position.
Figure 3:
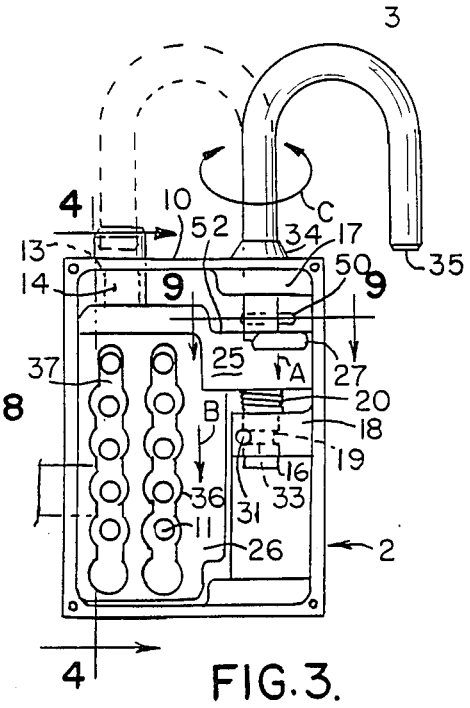
FIG. 3 is a front elevation view of the lock of this invention with the face plate removed showing the unlocked position and illustrating the reciprocating action of the thumb latch assembly and the swivel action of the shackle.

Continuing with FIG. 1, the thumb latch assembly 4 comprises a thumb latch block 25, to which is separately or integrally attached a locking plate 26, a projecting break-away thumb latch 27 and a sleeve 14. The thumb latch block also has disposed therein adjacent one marginal edge a hole 28 which is axially coordinate with holes 15 and 19 to receive the entrained end 16 of the J-shaped shackle. As best seen in FIGS. 2 and 3, when assembled, the sleeve 14 of the thumb latch assembly 4 is received through hole 13 in the top wall 10 of the housing. In addition, the hole 15 in the upper journal block 17, hole 28 in thumb latch block 25, and hole 19 in the lower journal block 18 are all axially aligned with the entrained end 16 of the J-shaped shackle being received therein. The compression spring 20 is disposed between the lower face 29 of the thumb latch block 25, and the upper face 30 of the lower journal block 18. This is best shown in FIGS. 2 and 3.

After the entrained end 16 of the shackle 3 is inserted in the journal blocks 17 and 18 as above-described, shackle retaining pin 31 is screwed or press fit into hole 32 in the lower journal block 18. As best seen in FIGS. 2 and 3, the shackle retaining pin 31 engages groove 33 in the shackle, thus preventing the shackle from being pulled out of the lock. Preferably, the shackle groove 33 is disposed adjacent the end of the entrained portion 16 of the shackle to engage the shackle retaining pin 31 located in hole 32 in the lower journal block 18. This increases the strength of the shackle 3, since there is less opportunity to apply a bending moment to the shackle than were the groove 33 disposed to engage the shackle retaining pin 31 when located in the upper journal block 17. The groove and pin are sized to permit pivoting rotation of the shackle without binding, yet the groove is sufficiently deep and the shackle retaining pin of sufficient diameter that the shackle cannot be pulled out of the lock by deforming the shackle retaining pin short of totally destroying the lock. Preferably, both the shackle retaining pin and the surface area of the shackle groove 33 are hardened to improve the strength of the lock. Conveniently a plastic collar 34 (FIGS. 2 and 3) is placed adjacent the top plate 10 to seal the hole 15 therein. This is done most conveniently by slipping it over the short free end 35 of the shackle 3.

The locking plate 26 of the thumb latch assembly 4 has a series of holes 36 which in the locked position of the padlock are axially aligned with the holes 11 in the backplate 6 and the holes 46 in the button block 45 and face plate 5 of the lock housing 2. The holes in each row are connected by a continuous slot 37, the width of which is less than the diameter of the holes 36. The slot also extends above the upper most hole by the amount of the vertical reciprocating motion desired for the thumb latch assembly 4. Preferably, the locking plate 26 may contain a depending marginal edge 38, and ribs 39, 40, best seen in FIGS. 1 and 6. The marginal edge and ribs are dimensioned to provide vertical spacing from the backplate 6, and sliding guidance there along.

Figure 6:
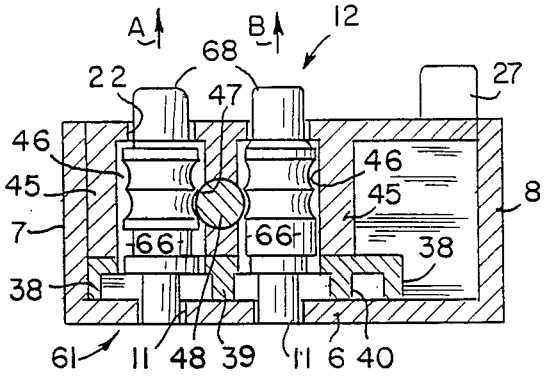
FIGS. 6–8 are a series in transverse sectional view (buttons not shown in section) taken along the lines 6—6, 7—7, and 8—8 of FIG. 2 showing the operations of the two types of buttons.
Figure 7:
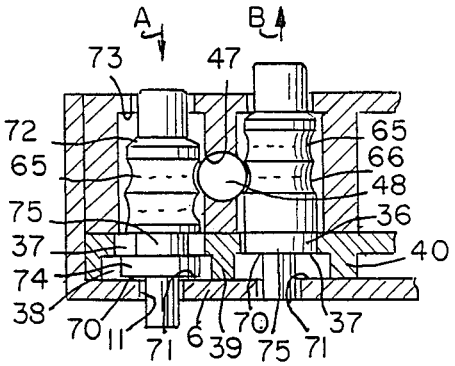
Figure 8:
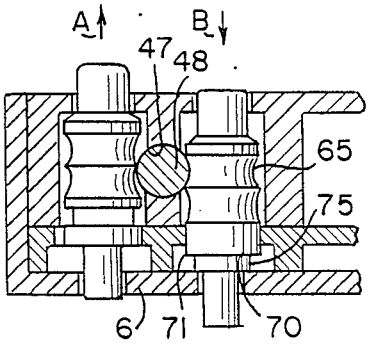

The face plate 5 has secured to, or integrate therewith, a button block 45 which has a series of, in this example, 10 button-receiving holes 46 which are axially aligned with the holes 11 in the backplate 6. In addition, the button block 45 contains a transversely oriented hole 47, which receives a button retainer member 48. The transverse hole 47 intersects each of the button holes 46 as best seen in FIGS. 6–8. The button retainer may be any resilient material, which is capable of retainingly engaging the sides of the buttons as will be described in more detail below. Preferably, it is a rubber or plastic resilient rod, but may also be of any other material, such as a metallic spring. In the preferred embodiment, the button retainer is a solid neoprene rod, sized to fit snugly in the hole 47.

The push-buttons 12 are provided in two different types, the so called Combination Button push-button A, and the Dead Pin B Button. As shown in FIGS. 1 and 11, the buttons have various square cut and semi-circular grooves spaced along the axial length thereof, the function of which is described in more detail in connection with the description of FIGS. 4–8 and 11 below.

The push-buttons are simply assembled into the face plate button block 45 by pushing them into the holes 46. The neoprene button retainer 48 engages one of the semi-circular grooves 65 or 66 and retains the pin in position while the lock is being assembled.

Figure 9:
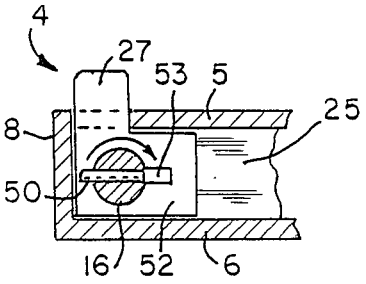
FIG. 9 is a partial transverse top sectional view taken along line 9—9 of FIG. 3 showing the two modes of operation of the pivot lock pin.

To assemble a lock, the thumb latch assembly 4 is inserted into the lock housing 2 as above-described with the sleeve 14 passing through the hole 13 in the top wall 10. Thereafter, the spring 20 is positioned and the entrained end 16 of the J-shaped shackle is inserted through the holes 15, 28, through the open center core of the spring 20 and thence into the hole 19 in the lower journal block ;8. The shackle-retaining pin 31 is then pressed into its receiving hole 32, and the shackle is thus secured into its operating position in the lock. The shackle can then be turned 90' and the pivot lock pin 50 is press-fit into hole 51 in the entrained portion 16 of the shackle. The functioning of the pivot lock pin 50 is best shown in FIGS. 2, 3 and 9. This pin 50, the hole 51 and the slot 53 are preferably case hardened for lock security.

As best seen in FIG. 9, the upper face 52 of thumb latch block 25 is provided with a groove 53 that receives the pivot lock pin 50 when the thumb latch assembly 4 is in its upper, locked (latched) position. This prevents opening the lock by rotating the shackle in the event the sleeve 14 is removed by a burglar, for example by attempting to saw the sleeve 14 off the thumb latch block 25 where it emerges from the top wall 10. The sleeve 14 is case hardened, as is the entire shackle. While unlikely, in the event the sleeve 14 is removed, the shackle still cannot pivot because the case hardened pivot lock pin 50 is trapped in the groove 53 preventing the shackle from turning. This is also seen in FIG. 2. Then, when the lock is opened by reciprocating the thumb latch assembly 4 downwardly, the pin 50 is released from the groove 53 and the shackle can be pivoted. Since there is only one groove on the face 52 of the block 25, the portion of pin 50 extending beyond the outer margin of the shackle 16 (see FIG. 9) can rest on the upper surface 52 of the thumb latch block 25, thus maintaining the thumb latch in the downward released (unlocked) position. This prevents the lock from locking when the shackle is in the open position.

Continuing with the assembly, the face plate 5 (containing the button retainer member 48 in its hole 47 in button block 45 and the push-buttons 12 positioned in holes 46) is then placed over the thumb latch assembly 4, with the buttons passing through the holes 36 in locking plate 26, and thence through the holes in the backplate. To complete the assembly, one or more pins 55 are press fit through holes 56 in the face plate 5 and thence into correspondently aligned bores 57 along the corner edges of the lock housing 2. As an alternative to press fitting, the face plate 5 may be secured by adding appropriate non-removable fastening means, such as one-way screws, headless screws, spot welding, locking bolts, etc. FIGS. 1–3 show the face plate 5, secured to the top of the housing 2, while FIGS. 4–10 and 12 show an alternate arrangement where the face plate 5 is inset in the housing 2.

The face plate also includes a relieved portion or notch 58, in which the break-away thumb latch 27 is received, and which is vertically long enough to permit reciprocation of the thumb latch from its upper locked position to its lower open position. The operation of the lock is best shown in FIGS. 2–8 and 12. FIGS. 2, 3 show the lock in front elevation with the face plate 5 removed to show the operation of the thumb latch assembly 4. FIG. 2 shows the thumb latch assembly 4 in its uppermost position which corresponds to the locked position in which the short, free end 35 of the J-shaped shackle is received in sleeve 14. Since the shackle retaining pin 31 is in place, the shackle cannot be reciprocated upwardly out of the sleeve 14. Since the buttons lock the locking plate 26 in its upward position (as described in more detail below with respect to FIGS. 4 through 8), the thumb latch assembly 4 cannot be reciprocated downwardly to release the shackle from the sleeve 14. Further, the shackle cannot be rotated because the pivot lock pin 50 is received in and engages the groove 53 in the upper face 52 of the thumb latch block 25.

FIG. 3 now shows the thumb latch assembly being reciprocated downwardly as best shown by arrow A. This is accomplished by thumb pressure on the upper surface of the break-away thumb latch 27. This is occasioned by pushing the correct combination of push-buttons which releases locking plate 26, which permits it to reciprocate downwardly as best shown by Arrow B. That causes the sleeve 14 to retract through hole 13 into the interior of the lock housing 2. This releases the pin 50 from its groove 53, thus permitting the shackle to pivot about the axis of the entrained end as best shown by Arrow C. The initial position of the shackle after opening is shown by the dotted line in FIG. 3, and the fully open position is shown in solid lines. Note that there is only minimal clearance between the free end 35 of the shackle 3 and the top face of the top plate 10.

To relock the lock, the shackle is pivoted back to the position shown in dashed lines in FIG. 3, then pressure is released from the thumb latch 27 and the spring 20 urges the thumb latch block 25 upwardly, thus bringing the locking plate 26 back to the locked position as shown by Arrow D in FIG. 2. The push-buttons are then returned to either one of their neutral positions and the locking is complete. The "neutral" button position is either all buttons being in the up position, or all buttons being depressed. When the buttons are in the up position, the lower end of the A and B buttons are substantially flush with the back surface of the back plate 6. When the buttons are all depressed, then the top most end of the locking buttons are substantially flush with the outside surface 60 of face plate 5.

Figures 11A, 11B:
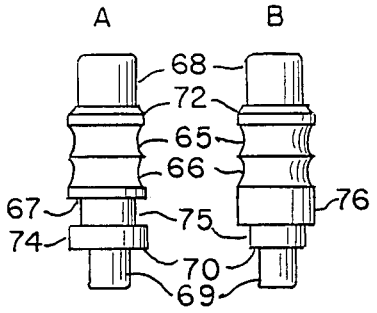
FIGS. 11A and 11B are elevation views of the two types of buttons, FIG. 11A showing a Type A combination button, and FIG. 11B showing a Dead Pin B Button.
Figure 12:
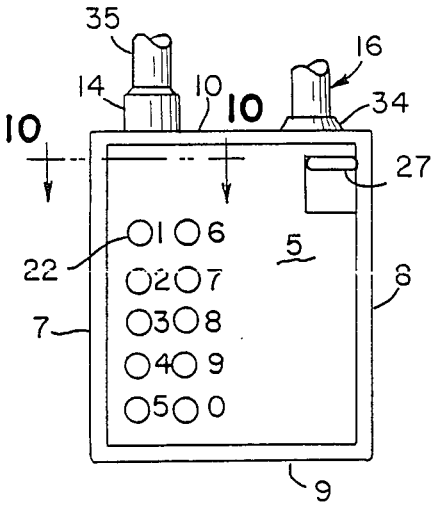
FIG. 12 is a partial front elevation view of the padlock face showing the thumb latch and numbered push-button holes.

Turning now to FIG. 11, FIGS. 11A and 11B show the two different kinds of buttons, the Combination Pin Type A button, shown in FIG. 11A, and the Dead Pin Type B button, shown in FIG. 11B. As shown in FIG. 12, the array of button holes and buttons which fit therein may be numbered. In the examples shown, the buttons/button holes are numbered consecutively in a vertical manner 1–5 in the first, left side row, and 6–0 (10) in the right hand vertical row. In order to provide a combination 1-3-7-9, four of the A buttons, which are the Combination Pin Type A buttons shown in 11A are inserted in the corresponding holes 1, 3, 7, and 9. The Dead Pin Type B buttons are then placed in the remaining holes 2, 4, 6, 8, and 0 (10). This provides for a 4-button combination. The combination can be changed to a 3-button combination simply by using three type A buttons, the Combination Pin Type A buttons shown in FIG. 11A in the appropriate holes chosen for the correct combination numbers, while seven of the Dead Pin Type B buttons are used in the remaining holes.

It should be noted that in the lock of this invention, the sequence of pushing the buttons is irrelevant. The buttons can be pushed in any sequence. Thus, in the case of the four button combination, it can be pushed in sequence 1-3-7-9, or 7-3-1-9, or 9-3-1-7, etc., in all combinations of those four numbers.

It can be noted from review of FIGS. 2 and 4–8, that the outer diameter of the push-buttons 12 is slightly less than the diameter of the button holes 46 and button block 45. Referring now to FIGS. 11 and B, the "throw", that is the up and down (in and out) travel of the buttons in the lock housing is confined by the shoulders 70 and 72 on both types of buttons, the Combination Pin Type A and the Dead Pin Type B button shown in FIGS. 11A and 11B respectively. As shown best in FIG. 11, the two types of push-buttons, also referred to as "pins" herein, are uniquely oriented with the top end 68 of a larger diameter than bottom end 69, which is of a smaller diameter. As illustrated in FIGS. 4–8 each pin is allowed to move vertically up and down a limited distance. The button holes 44 as best illustrated in FIG. 12 of the face plate 5 are of sufficient diameter to permit passage only of the top end 68 of the pins. Vertically upward movement is prevented by the upper shoulder 72 coming into contact with the inside surface 73 of the face plate 5. Similarly the holes 11 in the back plate 6 are of a diameter just sufficient to permit passage only of the bottom end 69 of the pins. Holes 11 are too small for the larger upper end 68 of pin 12 so the pins cannot be improperly assembled in the lock. Further vertically downward movement is prevented by lower shoulder 70 coming into contact with the inner surface 71 of the back plate 6.

As best illustrated in FIG. 11, each pin has an upper arcuate groove 65 and a lower arcuate grove 66. Beneath the lower arcuate groove on each pin are two separate diameters formed by square cut notches in the lower portion of each pin above the bottom end 69.

FIG. 11A shows a Combination Pin having a shoulder 67 located between the lower semicircular groove 66 and the passing diameter 75, followed by a blocking diameter 74 that is of equal outer diameter to the shoulder 67. That is, groove 75 is spaced above the small end 69 by an enlarged portion 75. FIG. 11B shows a Dead Pin having blocking diameter 76 located between the lower annular groove 66, and passing diameter 75. The axial length (height) of the blocking diameter 76 of the Dead Pin is equal to the combined height of the shoulder 67 and the passing diameter 75 of the Combination Pin. The heights of the passing diameter 75 of the Dead Pin and both the passing diameter 75 and the blocking diameter 74 of the combination pin are substantially equal. Note also that the passing diameter portions of the two pairs are reversed in position with respect to each other. In the Combination Pin it is above the blocking portion, and in the Dead Pin it is below.

Figure 4:
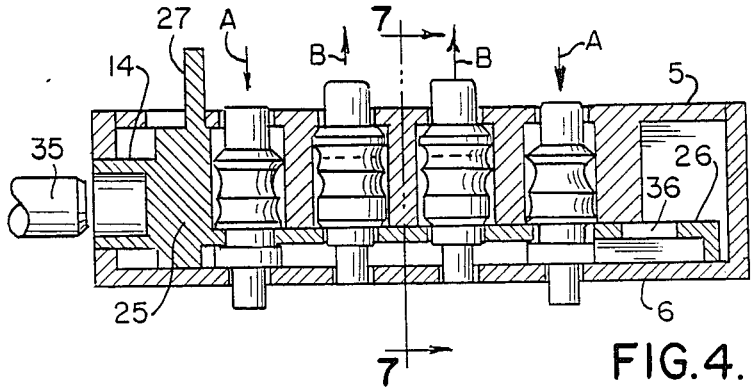
FIGS. 4 and 5 are a pair of longitudinal partial section views (buttons not shown in section) showing the functioning of the push-buttons to lock and unlock the padlock internal locking mechanism.
Figure 5:
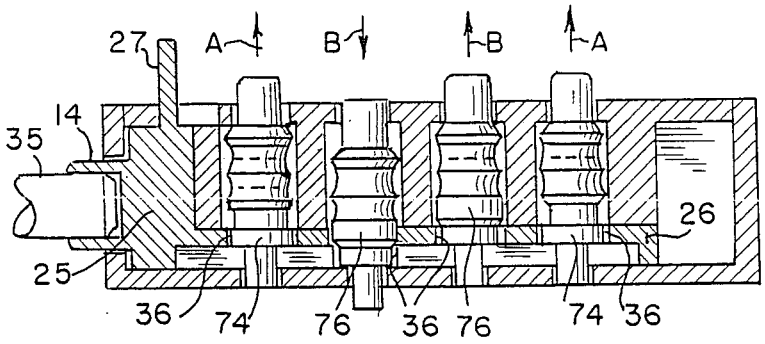

FIGS. 4 and 5 are longitudinal partial section views (buttons not shown in section) along lines 4—4 and 5—5 in FIGS. 2 and 3 respectively. A row of 4 push-buttons are shown rather than the row of 5 in FIGS. 2 and 3. The locking plate 26 can only be moved when all of the Combination Pins are depressed and none of the Dead Pins are depressed. FIG. 4 shows one row of push-buttons in which two Combination Pins are depressed, two Dead Pins are un-depressed, and the breakaway thumb latch 27 is activated causing the thumb latch block 25 and the locking plate 26 to be moved to the open position. The sleeve 14 has retracted into the lock housing thereby releasing the short free end 35 of Shackle 3. FIG. 5 shows how the locking plate 26 is prevented from moving when a Dead Pin is depressed (second button from left in FIG. 5), and/or Combination Pin is not depressed (left most or right most button in FIG. 5). The blocking diameter 76 of the depressed Dead Pin effectively plugs the locking plate hole 36 through which it passes, preventing the continuous slot from sliding past the depressed Dead Pin. Note that the two un-depressed Combination Pins having a blocking diameters 76 aligned with their corresponding locking plate holes 36 also prevent the locking plate from moving.

Turning now to FIGS. 6–8, these figures are a series of transverse sectional view taken along the lines 6—6, 7—7 and 8—8 of FIG. 2 showing the functioning of the button retainer member 48 and the positive action of the two types of push-buttons in the button block 25. Preferably the button retainer is a tough, long wearing elastomer such as neoprene or urethane with a 60 to 90 durometer range. FIG. 6 shows the two types of buttons in the undepressed position with their lower arcuate grooves 66 engaged with the button retainer 48. FIG. 7 shows the depression of a Combination Pin that has moved past the button retainer 48 to a fixed second depressed position wherein the upper arcuate groove 65 now engages the button retainer. Note that the depressed Combination Pin is prevented from further movement past the button retainer 45 beyond the upper arcuate groove 65 by the stop shoulder 70 of the blocking diameter 74 engaging with the inner surface 71 of the back plate 6. FIG. 8 shows a complimentary view to FIG. 7 in which a Dead Pin is depressed having its upper arcuate groove 65 engaged with the button retainer member 48. This Dead Pin is presented from further movement downward by the stop shoulder 70 of the passing diameter 75 engaging the inner surface 71 of the back plate 6.

As best illustrated in cross section in FIG. 7, a Combination Pin is in the depressed position with the passing diameter portion 75 lined up with the continuous slot 37, shown in phantom, and the locking plate hole 36. Note also that when the Dead Pin is not depressed, the passing diameter 75 corresponding to the dead pin is lined up with the continuous slot 37 and the locking plate hole 36. As best illustrated in FIG. 7, it is important to note that the length along the vertical axis of the passing diameter 75 of the Dead Pin and the blocking diameter 74 and passing diameter 75 of the Combination Pin are equal and are marginally less than the height of the marginal edge 38 and ribs 39 and 40 and the distance that denotes the depth of the locking plate holes 11. These relative length specifications are necessary to allow the locking plate 26 to slide past the passing diameter 75 and locking diameter 74 of the Combination Pin when it is depressed. Correspondingly, the locking plate 26 will then slide past the passing diameter 75 of the un-depressed Dead Pin.

Figure 10:
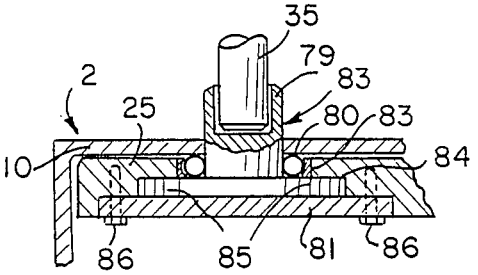
FIG. 10 is a sectional view taken along line 10—10 of FIG. 12 showing in partial cross section a rotatable sleeve configuration that is incorporated into the thumb latch block.

FIG. 10 shows a journaled rotating sleeve 79 as an alternate means for retaining the short, free end 35 of the shackle 3, instead of the fixed sleeve 14 as seen in FIG. 2. A rotatable sleeve is particularly useful to deter tampering with the lock. A certain amount of play may be necessary for ease of closure. By providing a rotatable sleeve, the sleeve becomes very difficult to saw since the sleeve spins freely under the reciprocating of the saw. This rotation can be accomplished by using a ball bearing arrangement 80, or other simple bearing surface, that encircles the journaled rotating sleeve 79 which is bounded by a bearing race 82 seated in the uppermost portion of the thumb latch block 25, and by outer surface 83 of the journaled rotating sleeve 79.

FIG. 10 also shows the upper portion of the flange 85 of the journaled rotating sleeve 79 secured into the thumb latch block 25 by a notch-cut shoulder 84 and the lower portion of the flange 85 secured by a retainer plate 81. This retainer plate is affixed to the thumb latch block by any appropriate fastener 86, such as machine screws, press fit pins, or the like.

It should be understood that various modifications within the scope of this invention can be made by one of ordinary skill in the art without departing from the spirit thereof. For example, the push-button locking mechanism disclosed herein may be used with a variety of shackle and shackle latch types, such as reciprocating shackles, and a variety of housing types and shapes, such as round, square, cubic, rectangular, etc. Conversely the pivot-only shackle and/or reciprocating thumb latch assembly with sleeve may be used alone or in combination with a wide variety of locking mechanisms such as rotary dial locks, cylinder dial (brief case type) locks, key locks, or other push-button configurations. In addition, while the pins are shown for convenience as round, they may be square, rectangular, triangular (polygonal) in cross section, and the section-/elevation views FIGS. 4–8 and 11 remain the same. The term "diameter", as in passing or blocking diameter, thus refers to the width of the push button or pin. We therefore wish our invention to be defined by the scope of the appended claims as broadly as the prior art will permit, and in view of the specification if need be.

We claim:

1. A padlock having a first locked mode and a second unlocked mode, comprising in operative combination;
   (a) a housing having a front face, a back face spaced from said front face, and at least one wall disposed between said faces to form a perimeter wall of said housing, said faces and said wall defining a volume in said housing, said perimeter wall having at least a first hole and a second hole therethrough;
   (b) a shackle formed in a generally inverted J-shape, having a generally cylindrical first entrained portion and a second free end portion, said first and said second portions being joined by an intermediate portion;
      (i) said shackle being disposed with said first entrained portion mounted through said perimeter wall first hole into said housing volume to only rotate at least partially around the longitudinal axis of said first cylindrical entrained portion,
      (ii) said intermediate portion, and said free end portion being disposed external of said housing in both said locked and said unlocked modes;
   (c) a reciprocating latching assembly having means for receivingly engaging said free end portion of said shackle external of said perimeter wall;
      (i) said latching assembly being disposed mounted in said housing with said shackle free end engaging means reciprocatingly movable in said second hole in said perimeter wall;
   (d) means for selectively locking said latching assembly to prevent pivoting release of said shackle free end portion from said reciprocating receivingly engaging means, and to provide said first locked mode and said second unlocked mode, so that upon selective release of said latching assembly said latching assembly may be reciprocatingly actuated to release externally of said perimeter wall said shackle free end and permit pivoting only of said shackle by at least partial rotation of said shackle around said entrained cylindrical axis thereof.

2. A padlock as in claim 1 wherein:
   (a) said shackle is uniformly cylindrical adjacent said free end; and
   (b) said shackle free end engaging means includes a hardened sleeve having an annular cross section with an inner diameter sufficient to receive said shackle free end with a minimum tolerance.

3. A padlock as in claim 2 wherein said sleeve is rotatable about its longitudinal axis.

4. A padlock as in claim 2 wherein said sleeve includes a chamfer disposed at the open upper end.

5. A padlock as in claim 3 wherein said sleeve includes a chamfer disposed at the open upper end.

6. A padlock as in claim 2 wherein said sleeve includes a centrally disposed rod member extending upwardly into a mating bore disposed in said free end of said shackle, and the surfaces of said sleeve, said rod, said bore and said shackle are hardened.

7. A padlock as in claim 3 wherein said sleeve includes a centrally disposed rod member extending upwardly into a mating bore disposed in said free end of said shackle, and the surfaces of said sleeve, said rod, said bore and said shackle are hardened.

8. A padlock as in claim 1 wherein said latching assembly includes means for manually reciprocatingly actuating said latching assembly.

9. A padlock as in claim 8 wherein:
   (a) said housing includes a third hole; and
   (b) said manual actuating means projects through said third hole.

10. A padlock as in claim 9 wherein said third hole is disposed in the front face of said housing.

11. A padlock as in claim 9 wherein said manual actuating means includes a thumb latch member disposed to project through said third hole in said housing.

12. A padlock as in claim 11 wherein said thumb latch member is adapted to permit said thumb latch to break away.

13. A padlock as in claim 12 wherein said breakaway adaption comprises a weakened portion of said thumb latch adjacent said housing.

14. A padlock as in claim 13 wherein said weakened portion is a relieved portion in said thumb latch member.

15. A padlock as in claim 8 wherein said housing includes a third hole, and said latching assembly includes a relieved portion therein disposed within the volume of said housing adapted for manually actuation by a member, such as a finger.

16. A padlock as in claim 15 wherein said third hole is disposed in the front face of said housing.

17. A padlock as in claim 8 wherein:
   (a) said shackle is uniformly cylindrical adjacent said free end; and
   (b) said shackle free end engaging means includes a hardened sleeve having an annular cross section with an inner diameter sufficient to receive said shackle free end with minimum tolerance.

18. A padlock as in claim 11 wherein:
   (a) said shackle is uniformly cylindrical adjacent said free end; and
   (b) said shackle free and engaging means includes a hardened sleeve having an annular cross section with an inner diameter sufficient to receive said shackle free end with minimum tolerance.

19. A padlock as in claim 12 wherein:
   (a) said shackle is uniformly cylindrical adjacent said free end; and
   (b) said shackle free and engaging means includes a hardened sleeve having an annular cross section with an inner diameter sufficient to receive said shackle free end with minimum tolerance.

20. A padlock as in claim 8 wherein said sleeve is rotatable about its longitudinal axis.

21. A padlock as in claim 11 wherein said sleeve is rotatable about its longitudinal axis.

22. A padlock as in claim 12 wherein said sleeve is rotatable about its longitudinal axis.

23. A padlock as in claim 18 wherein said sleeve includes a centrally disposed rod member extending upwardly into a mating bore disposed in said free end of said shackle, and all the surfaces of said sleeve, said rod, said bore and said shackle are hardened.

24. A padlock as in claim 19 wherein said sleeve includes a centrally disposed rod member extending upwardly into a mating bore disposed in said free end of said shackle, and all the surfaces of said sleeve, said rod, said bore and said shackle are hardened.

25. A padlock as in claim 20 wherein said sleeve includes a centrally disposed rod member extending upwardly into a mating bore disposed in said free end of said shackle, and all the surfaces of said sleeve, said rod, said bore and said shackle are hardened.

26. A padlock as in claim 1 which includes:

(a) a pivot lock pin mounted in said shackle to project from the surface thereof adjacent said shackle first entrained end; and said reciprocating latching assembly having means for receivingly engaging said free end portion of said shackle;

(b) a relieved portion defining a slot disposed to receive said shackle pivot lock pin to prevent said shackle from swiveling by engagement of said pin in said slot, and said locking assembly upon reciprocation releases said pin from said slot to permit swiveling of said shackle after appropriate unlocking of said selective locking means.

27. A padlock as in claim 2 which includes:

(a) a pivot lock pin mounted in said shackle to project from the surface thereof adjacent said shackle first entrained end; and (b) a relieved portion defining a slot disposed to receive said shackle pivot lock pin to prevent said shackle from swiveling by engagement of said pin in said slot, and said locking assembly upon reciprocation releases said pin from said slot to permit swiveling of said shackle after appropriate unlocking of said selective locking means.

28. A padlock as in claim 3 which includes:

(a) a pivot lock pin mounted in said shackle to project from the surface thereof adjacent said shackle first entrained end; and (b) a relieved portion defining a slot disposed to receive said shackle pivot lock pin to prevent said shackle from swiveling by engagement of said pin in said slot, and said locking assembly upon reciprocation releases said pin from said slot to permit swiveling of said shackle after appropriate unlocking of said selective locking means.

29. A padlock as in claim 8 which includes:

(a) a pivot lock pin mounted in said shackle to project from the surface thereof adjacent said shackle first entrained end; and (b) a relieved portion defining a slot disposed to receive said shackle pivot lock pin to prevent said shackle from swiveling by engagement of said pin in said slot, and said locking assembly upon reciprocation releases said pin from said slot to permit swiveling of said shackle after appropriate unlocking of said selective locking means.

30. A padlock as in claim 11 which includes:

(a) a pivot lock pin mounted in said shackle to project from the surface thereof adjacent said shackle first entrained end; and (b) a relieved portion defining a slot disposed to receive said shackle pivot lock pin to prevent said shackle from swiveling by engagement of said pin in said slot, and said locking assembly upon reciprocation releases said pin from said slot to permit swiveling of said shackle after appropriate unlocking of said selective locking means.

31. A padlock as in claim 12 which includes:

(a) a pivot lock pin mounted in said shackle to project from the surface thereof adjacent said shackle first entrained end; and (b) a relieved portion defining a slot disposed to receive said shackle pivot lock pin to prevent said shackle from swiveling by engagement of said pin in said slot, and said locking assembly upon reciprocation releases said pin from said slot to permit swiveling of said shackle after appropriate unlocking of said selective locking means.

32. A padlock as in claim 1 wherein:

(a) said shackle includes an annular groove disposed in said entrained end;

and which includes:

(b) a shackle retaining pin secured to said housing and disposed to engage said groove to permit said shackle to pivot only and to prevent said shackle from being withdrawn from said housing.

33. A padlock as in claim 2 wherein:

(a) said shackle includes an annular groove disposed in said entrained end; and which includes:

(b) a shackle retaining pin secured to said housing and disposed to engage said groove to permit said shackle to pivot only and to prevent said shackle from being withdrawn from said housing.

34. A padlock as in claim 3 wherein:

(a) said shackle includes an annular groove disposed in said entrained end;

and which includes:

(b) a shackle retaining pin secured to said housing and disposed to engage said groove to permit said shackle to pivot only and to prevent said shackle from being withdrawn from said housing.

35. A padlock as in claim 8 wherein:

(a) said shackle includes an annular groove disposed in said entrained end;

and which includes:

(b) a shackle retaining pin secured to said housing and disposed to engage said groove to permit said shackle to pivot only and to prevent said shackle from being withdrawn from said housing.

36. A padlock as in claim 9 wherein:

(a) said shackle includes an annular groove disposed in said entrained end;

and which includes:

(b) a shackle retaining pin secured to said housing and disposed to engage said groove to permit said shackle to pivot only and to prevent said shackle from being withdrawn from said housing.

37. A padlock as in claim 12 wherein:

(a) said shackle includes an annular groove disposed in said entrained end;

and which includes:

(b) a shackle retaining pin secured to said housing and disposed to engage said groove to permit said shackle to pivot only and to prevent said shackle from being withdrawn from said housing.

38. A padlock as in claim 26 wherein:

(a) said shackle includes an annular groove disposed in said entrained end;

and which includes:

(b) a shackle retaining pin secured to said housing and disposed to engage said groove to permit said shackle to pivot only and to prevent said shackle from being withdrawn from said housing.

39. A push-button lock assembly having: a housing including a front and a back face spaced therefrom and a plurality of pairs of coordinate holes in said front and back faces through which push-buttons project, a push-button locking mechanism having a plurality of push-buttons disposed in said housing and a selectively openable member in operative engagement with said locking mechanism, wherein said push-button locking mechanism includes in operative combination:

(a) a plurality of push-buttons;

(b) a button block member having:

(i) a longitudinal bore therein, (ii) a plurality of pairs of holes transverse to said bore with each pair being disposed in spaced substantially equidistant relationship on each side of said bore and coordinate with said housing holes;

(iii) said holes being adapted for receiving and retaining individual ones of said push-buttons in each of said plurality of pairs of holes;

(iv) at least a portion of said bore intersecting each of said button holes; and an elongated resilient member disposed in said longitudinal bore for simultaneously engaging each of said buttons disposed in said plurality of pairs of button holes so as to retain said buttons in a plurality of preselected positions while permitting them to move from at least a first position to a second position by pressure applied to each said button.

40. A push-button lock assembly as in claim 39 wherein:

(a) said push-buttons each have an up position and a depressed position and are retained in each of said two positions by engagement with said resilient member.

41. A push-button lock assembly as in claim 39 wherein:

(a) said push-buttons comprise generally elongated cylindrical members having a longitudinal axis coordinate with the axis of said button hole, comprising:

(i) a top end portion of a first diameter;

(ii) a bottom end portion of a second diameter different than said first diameter so that said push-buttons have a unique operational orientation when mounted in said button block;

iii) at least one annular groove disposed intermediate of said top end portion and said bottom end portion;

(iv) an enlarged portion comprising a blocking diameter and a reduced portion comprising a passing diameter adjacent said bottom end portion;

(v) said passing and blocking diameter portions being disposed adjacent each other and intermediate of said annular groove and one of said end portions;

(b) said annular groove being adapted to retain said push-button in one of said two positions by matingly engaging said resilient number.

42. A push-button lock assembly as in claim 41 wherein said push-button includes at least two annular grooves having arcuate cross sections said arcuate grooves being disposed adjoining each other so that there is an intermediate lip therebetween one of said grooves corresponding to said "up" push-button position and the other groove corresponding to said "depressed" push-button

43. A push-button lock assembly as in claim 41 wherein:

(a) said passing diameter portion is smaller than said blocking diameter portion, and said two portions are disposed adjoining each other.

44. A push-button lock assembly as in claim 43 wherein:

(a) at least one of said push-buttons is of a first, combination pin button configuration wherein;

(i) said passing diameter portion is disposed intermediate said lowermost annular arcuate groove and said blocking diameter portion;

(ii) said locking mechanism includes a locking plate member disposed to reciprocate between a first locked position to a second openable position, said locking plate member includes a plurality of holes disposed coordinate with said button block holes having a diameter sufficient to permit clearance of said push-button blocking diameter portion, said holes in said locking plate being interconnected by at least one slot of width less than said blocking diameter portion but sufficient to permit clearance of said push-button passing diameter portion; and (iii) said first configuration push-button, when disposed in said button block and received through said holes in said locking plate prevents said locking plate from reciprocating when said push-button is in said up position and allows said locking plate to reciprocate when said push-button is in said depressed position.

45. A push-button lock assembly as in claim 44 wherein:

(a) at least one of said push-buttons is of a second dead pin button configuration wherein:

(i) said blocking diameter portion is disposed intermediate said lowermost annular arcuate groove and said blocking diameter portion;

(ii) said second configuration push-button, when disposed in said button block and received through said holes in said locking plate allows said locking plate to reciprocate when said push-button is in said up position and prevents said locking plate from reciprocating when said push-button is in said depressed position.

46. A push-button lock assembly as in claim 45 wherein:

(a) said back face holes in said housing have a diameter sufficient to provide clearance for movement of said bottom end portion of said push-button therethrough;

(b) said blocking diameter corresponding to said push-button of said first configuration being larger than said diameter of said back face hole;

(c) said blocking diameter portion being adapted to define a shoulder stop to prevent further passage of said push-button through said back face hole;

(d) said passing diameter corresponding to said push-button of said second configuration being larger than said diameter of said back face hole, and (e) said passing diameter portion being adapted to define a shoulder stop to prevent further passage of said push-button through said back face hole.

47. A push-button lock assembly as in claim 46 wherein:

(a) said front face holes in said housing have a diameter sufficient to provide clearance for movement of said top end portion of said push-button therethrough, and (b) said push-buttons having a shoulder disposed adjacent said uppermost arcuate annular groove of sufficient diameter larger than said front face hole to provide upper stop to prevent further upward motion of said push-buttons beyond said up position through said top face holes in said housing.

48. A push-button lock assembly as in claim 47 wherein said selectively openable member is a shackle.

49. A push-button lock assembly as in claim 48 wherein said lock is a padlock.

50. A push-button lock assembly as in claim 47 wherein said selectively openable member is a bolt.

51. A push-button lock assembly having: a housing including a front and a back face spaced therefrom and a plurality of pairs of coordinate holes in said front and said back faces through which push-buttons project, a push-button locking mechanism having a plurality of push-buttons disposed in said housing and a selectively openable member in operative engagement with said locking mechanism, wherein said push-button locking mechanism includes in operative combination: a plurality of push-buttons each mounted in a button block member in a plurality of holes in each of two rows, a button retainer positioned between said two rows in said button block member for simultaneously engaging a plurality of buttons in each of said two rows, said button retainer and said buttons being constructed to retain said buttons in said button block member while allowing limited button movement relative to the front and back face of said housing.

52. The push-button lock assembly as defined in claim 51 wherein at least some of said buttons when moved in a predetermined direction permit selective release of said associated locking mechanism.

53. The push-button lock mechanism as defined in claim 52 wherein said locking mechanism includes a locking plate disposed to reciprocate in said housing between a first locked position and a second openable position.

54. The push-button lock mechanism as defined in claim 53 wherein said buttons engage said locking plate until certain of said buttons are moved in a predetermined direction to permit selective release of said locking plate.

55. The push-button lock mechanism as defined in claim 51 wherein said button retainer comprise an elongated rod which is sufficiently rigid to retain said buttons in said button block member while also being sufficiently resilient to permit said limited button movement.

56. The push-button lock mechanism as defined in claim 55 wherein each of said buttons are also configured to permit limited movement of said buttons relative to said button retainer and the front and back face of said housing.

57. The push-button lock mechanism as defined in claim 56 wherein certain of said buttons are configured to permit selective release of said locking mechanism when certain of said buttons are moved to a predetermined position.

* * * * *

UNITED STATES PATENT AND TRADEMARK OFFICE

CERTIFICATE OF CORRECTION

PATENT NO. : 4,862,714

DATED : September 5, 1989

INVENTOR(S) : Taylor et al.

It is certified that error appears in the above-identified patent and that said Letters Patent is hereby corrected as shown below:

Column 4, Line 11 is "illustrating push-buttons" should be "illustrating the push-buttons".

Column 6, Line 58 is ";8" should be "18".

Column 7, Line 27 is "holes in" should be "holes 11 in".

Column 8, Line 52 is "Figs. 11 and B" should be "Figs. 11A and B".

Claim 39
Column 15, Line 16 insert a "c)" before "an elongated".

Claim 42
Column 15, Line 61 is "push-button" should be "push-button position."

Claim 55
Column 18, Line 14 is "comprise" should be "comprises".

Signed and Sealed this

Second Day of October, 1990

*Attest:*

HARRY F. MANBECK, JR.

*Attesting Officer*

*Commissioner of Patents and Trademarks*